United States Patent [19]

Santoro

[11] Patent Number: 4,998,723

[45] **Date of Patent: * Mar. 12, 1991**

[54] CABLE SUSPENDED DUMBELL AND BARBELL WEIGHTLIFTING APPARATUS

[76] Inventor: John G. Santoro, 1900 Dant Blvd., Reno, Nev. 89509

[ * ] Notice: The portion of the term of this patent subsequent to Jun. 19, 2007 has been disclaimed.

[21] Appl. No.: 395,066

[22] Filed: Aug. 9, 1989

[51] Int. Cl.[5] ..... A63B 21/06

[52] U.S. Cl. ..... 272/117; 272/122; 272/123

[58] Field of Search ..... 272/117, 118, 123, 134, 272/144, DIG. 4

[56] References Cited

U.S. PATENT DOCUMENTS

| | | | |
|---|---|---|---|
| 4,153,244 | 5/1979 | Tauber, Jr. | 272/117 |
| 4,252,314 | 2/1981 | Ceppo | 272/117 |
| 4,256,301 | 3/1981 | Goyette | 272/123 |
| 4,420,154 | 12/1983 | Ramsey et al. | 272/118 |
| 4,441,706 | 4/1984 | Korzaniewski | 272/118 |
| 4,561,651 | 12/1985 | Hole | 272/123 |
| 4,564,194 | 1/1986 | Dawson | 272/123 |
| 4,700,944 | 12/1987 | Sterba et al. | 272/117 |
| 4,826,155 | 5/1989 | James | 272/123 |

FOREIGN PATENT DOCUMENTS

| | | | |
|---|---|---|---|
| 3528994 | 2/1987 | Fed. Rep. of Germany | 272/123 |

*Primary Examiner*—Robert Bahr

[57] ABSTRACT

A weightlifting apparatus for suspending weightlifting bars at a pre-selected height for the performance of a selected exercise. After the user completes the exercise the weightbearing bar remains suspended at the pre-selected height and allows the user to repeat the exercise by once again lifting the weightbearing bar. A series of holes in the vertical uprights provide a range of adjustment for setting slider assemblies to a pre-selected height. Cable support systems are used to suspend the weightbearing bar at a pre-selected height by attaching one of their ends to connectors attached to the weightbearing bar and their other ends are passed over a pulley system and then are attached to stop weights or slider assemblies. This support system will allow unrestricted movement of the weightbearing bar in any direction as in standard free weight systems and yet provide safety to the user not available with standard free weight systems.

20 Claims, 16 Drawing Sheets

CABLE SUSPENDED DUMBELL AND BARBELL WEIGHTLIFTING APPARATUS

FIELD OF THE INVENTION

This invention relates to a weightlifting device and more particularly to a weightlifting device which allows the unrestricted vertical or horizontal movement of dumbbells or a barbell during any exercise with complete safety and without the need for assistance by a partner. More specifically this invention allows dumbbells or a barbell used in any exercise to be suspended at a pre-selected height for the performance of a particular exercise. The dumbbells or a barbell will remain suspended at this pre-selected height after completion of an exercise, therefore allowing the exerciser to again repeat the exercise at the original pre-selected height.

BACKGROUND OF THE INVENTION

Exercising apparatus and equipment have been developed to provide various multi-function types of exercises. In the prior art various weightlifting equipment have been disclosed including those referenced in the following patents:

U.S. Pat. No. 4,153,244 to Tauber Jr. disclosed a gymnasium type equipment consisting of a weight bar attached to a pair of slides that are supported on vertical posts for performing vertical lifting exercises of the weight bar. Strap pins are used to limit the downward movement of the weight on the vertical slide posts.

U.S. Pat. No. 4,252,314 to L. Ceppo, a weightlifting device is disclosed including two upright members, a fixed weight carrying bar coupled to cylindrical members, in a frame having several uprights. The cylindrical members and upright members guide the weightlifting bar in a fixed vertical movement.

U.S. Pat. No. 4,564,194 to Dawson, a weightlifting station is disclosed including a pair of guide posts, a barbell assembly, a sleeve telescoped over the weight bar and stop pins attached to the sleeve. During the vertical movement of an exercise the sleeve can be rotated to engage the stop pins in holes of the guide posts.

U.S. Pat. No. 4,256,301 to Goyette, a weightlifting apparatus is disclosed comprised of a pair of laterally spaced upright posts for supporting a weighted bar, a slidable foot member, a bench to which the slidable member is attached, safety clamps and a wheeled pulley device. The weighted bar is connected by a strand to the foot member which allows a portion of the weight to be relieved by pushing on the foot member.

U.S. Pat. No. 4,441,706 to Korzaniewski, a weightlifting exercising device is disclosed including a vertically disposed framework defined by a pair of parallel, vertical, channel-shaped side members interconnected at the top and bottom by square tubing. A weightlifting bar is contained within the upright channel members and receiving pins are placed within the apertures of the vertical uprights at a pre-determined point so the bar can not be moved below this height to protect the exerciser.

U.S. Pat. No. 4,420,154 to Ramsey et al. is disclosed a weightlifting apparatus which includes a framework having a base, vertical support members which have a plurality of apertures, stop pins and an adjustment body within the slots of the vertical support members. A weightlifting bar is inserted between the slots of the vertical upright members. The adjustment means is set at a selected height to prevent injury to the weight lifter.

U.S. Pat. No. 4,561,651 to Hole is disclosed a weightlifting machine which includes a weight arresting bar, a detachable weight pulling assembly, a pair of upright members, pair of base members, adjustment mechanism with manually adjustable latches at each end of a stop bar to engage passages formed in the upright frame members. The stop bar limits the downward movement of the weights in order to prevent injury to the exerciser.

U.S. Pat. No. 4,700,944 to Sterba et al. is disclosed an exercise equipment which has upright guide tracks, a detachable bar carriage, detachable weight carriage, a pulley apparatus, a rotating bar apparatus and safety catch. The weight carriage is suspended within the upright guide tracks and can be positioned at a predetermined height. The weightlifting bar contained within the bar carriage is moved in a fixed path within the slots of the upright guide tracks.

U.S. Pat. No. 3,528,994 to Erbe, West Germany disclosed an exercise unit which includes dismantable holder rods, square-edge precision aluminum tubes, a jib arm, guide pulley arrangement and automatic locking supports. The weight bar is held in a defined vertical area and is moved in a fixed vertical direction. The bar has an automatic locking device which prevents the weight bar from descending on the weight lifter.

None of the above or any multi-function weightlifting system provides a safety system which allows unrestricted vertical or horizontal movement of dumbbells or a barbell, a means for the use of dumbbells for performing various exercises and the versatility and safety advantages of this particular weightlifting apparatus.

SUMMARY OF THE INVENTION

A principal object of the invention is to provide a multi-function free weight exercise apparatus for preventing injury to a weight lifter from the crashing down of dumbbells or a barbell during the performance of any exercise.

A further object of the invention is to provide an apparatus which combines the features of a free weight apparatus and a safety constrained apparatus but which makes available new advantages in weightlifting over both types of apparatus taken separately.

Another object of the invention is to take the features of a free weight system and a guided weightlifting system and innovatively incorporate them into an apparatus which provides a unique safety system for the use of free weights.

Still a further object of the invention is to employ a slider system, safety stop keys, cable harness, cable-pulley system which permits the safe use of dumbbells or a barbell in various exercises without the need for any assistance.

A still further object of this invention is to provide a safety system which limits the downward movement of dumbbells or a barbell during any exercise.

It is a further object of this invention to allow unrestricted vertical and horizontal movement of dumbbells or a barbell during the performance of any exercise.

Another object of the invention is to provide a slider system, safety stop keys, cable harness, and cable-pulley system which permits the positioning of dumbbells or a barbell at a pre-selected height for a particular exercise and after the exercise is completed the dumbbells or barbell remain suspended at the pre-selected height so that the exerciser may again repeat the exercise without having to retrieve and reposition the dumbbells or barbell at the desired starting position.

Another object of the invention is to allow the easy exchange of dumbbells with a barbell or vice versa without modification to the cable support system or the weightlifting apparatus.

A still further object of the invention is to allow the attachment of a handle to one end of the cable system and place a weighted bar through holes in the side of the slider assemblies which would allow the exerciser to perform pushdown and pulldown exercises.

A further object of the invention is to provide a multifunction free weight apparatus which is durable, compact, safe, easy to assemble and disassemble and which provides considerable versatility for performing free weight type lifting exercises.

BRIEF DESCRIPTION OF THE DRAWINGS

The above objects and features of the invention will become more readily apparent with reference to the following detailed description including the drawings in which like reference numerals refer to like parts.

DESCRIPTION OF THE PREFERRED EMBODIMENT

A principal feature of the invention resides in a safety device in the form of auxiliary means for supporting a weight bearing bar should, during exercising, the weight lifter be too exhausted to complete an exercise and have the weight bearing bar crash down on the exerciser.

Figure 1:
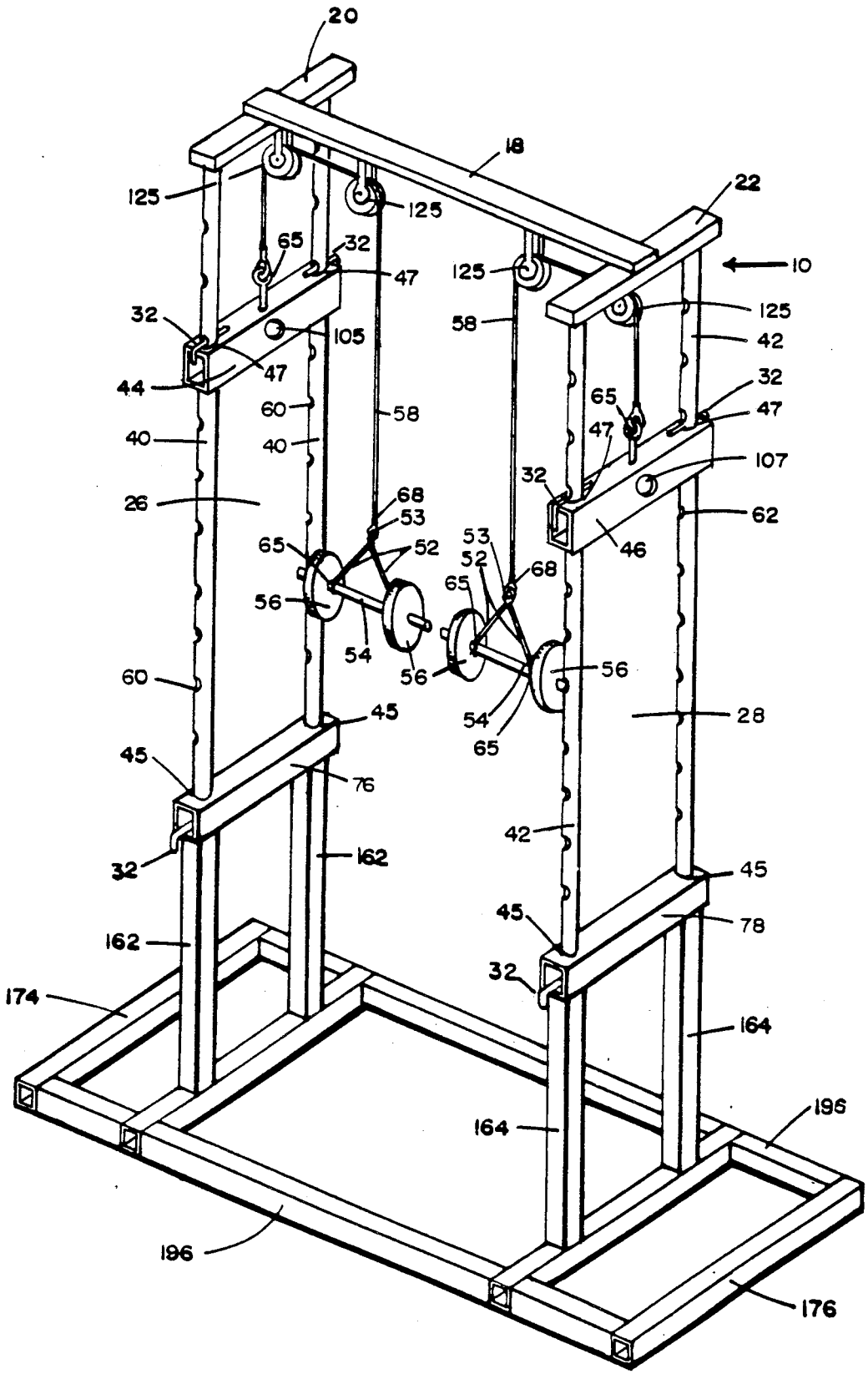
FIG. 1 is a perspective view of the preferred embodiment of the invention with dumbbells.
Figure 2:
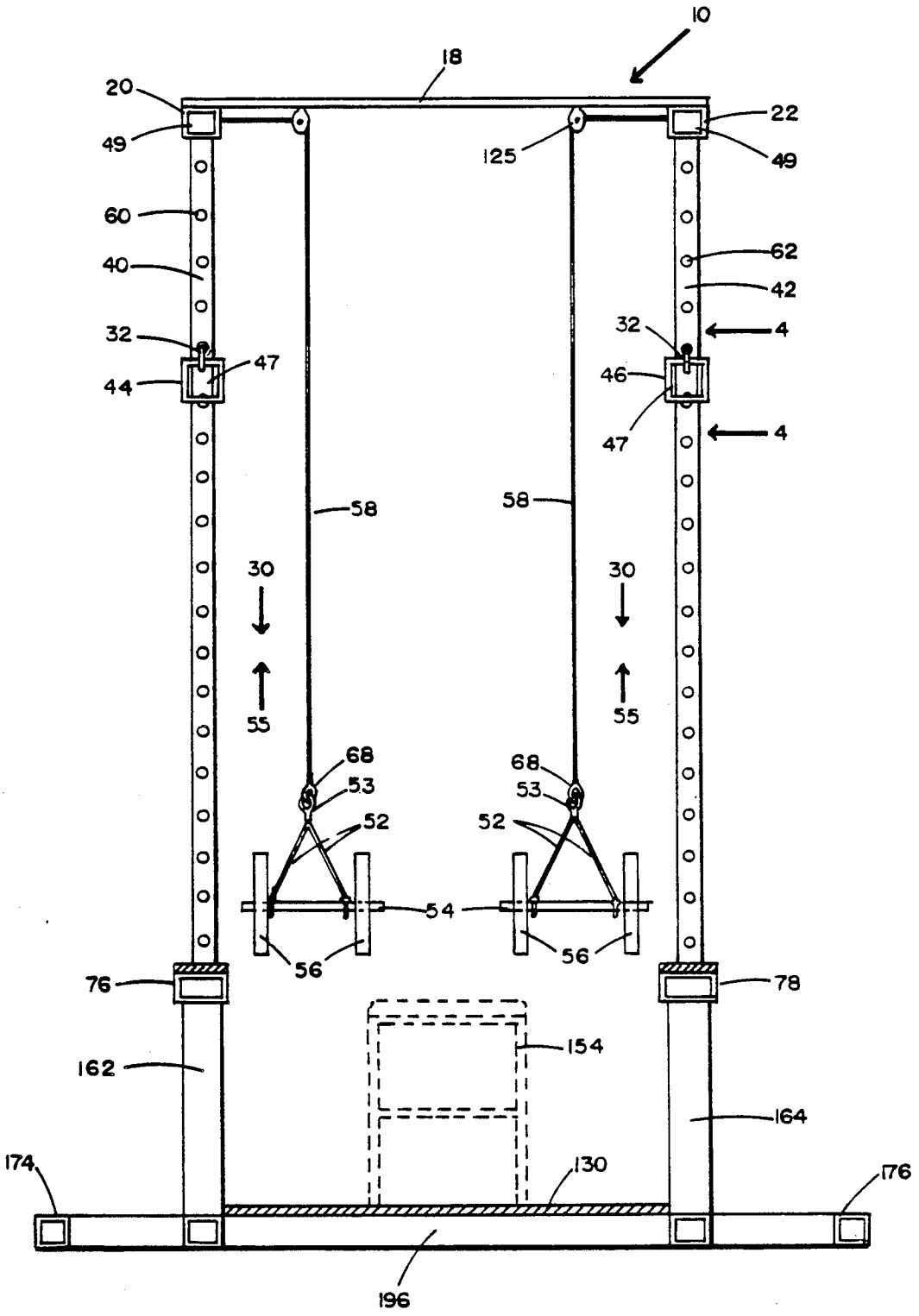
FIG. 2 is a front view of the preferred weightlifting apparatus with dumbbells.
Figure 3:
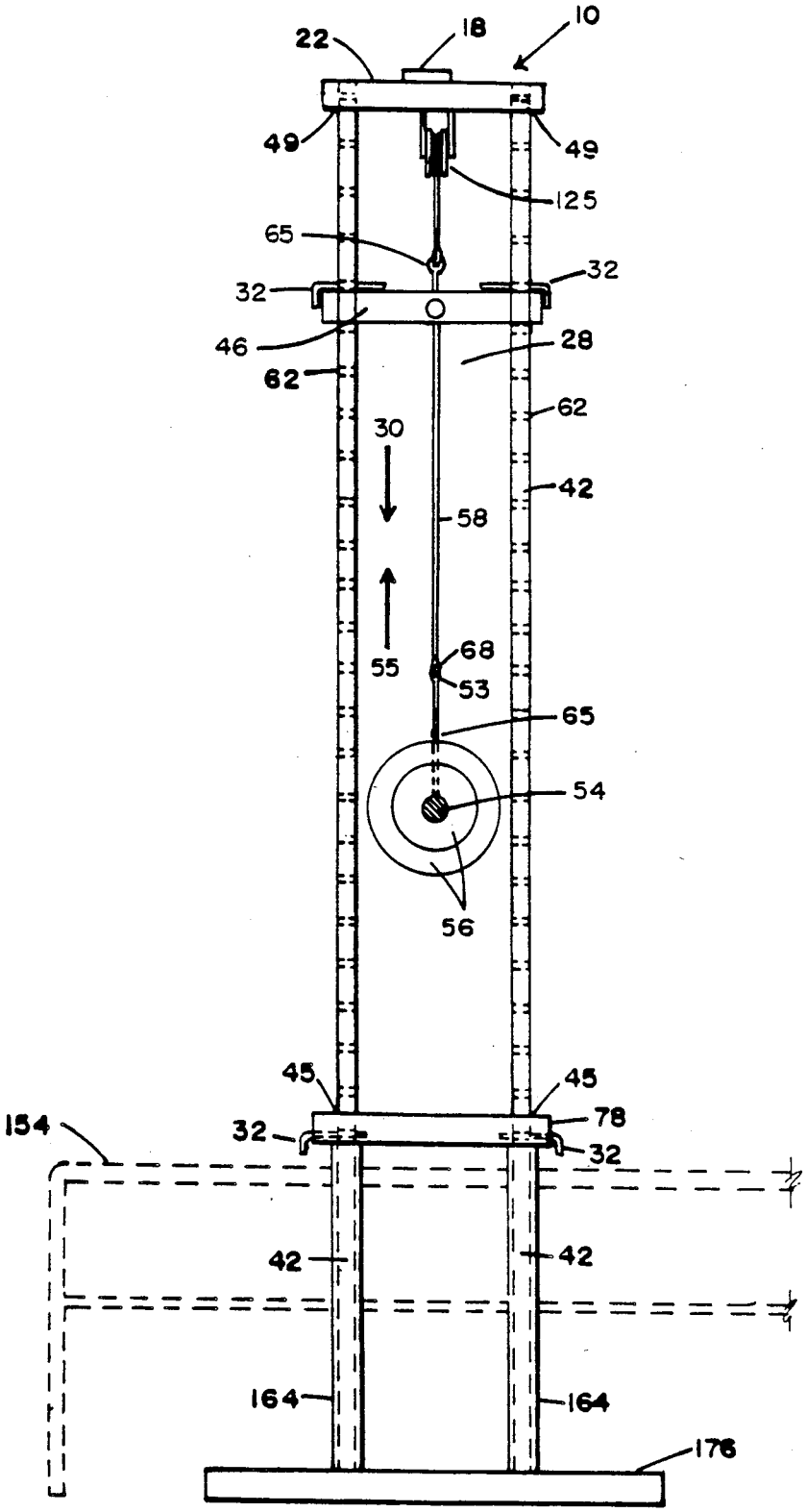
FIG. 3 is a side elevational view of the preferred invention with dumbbells.
Figure 4:
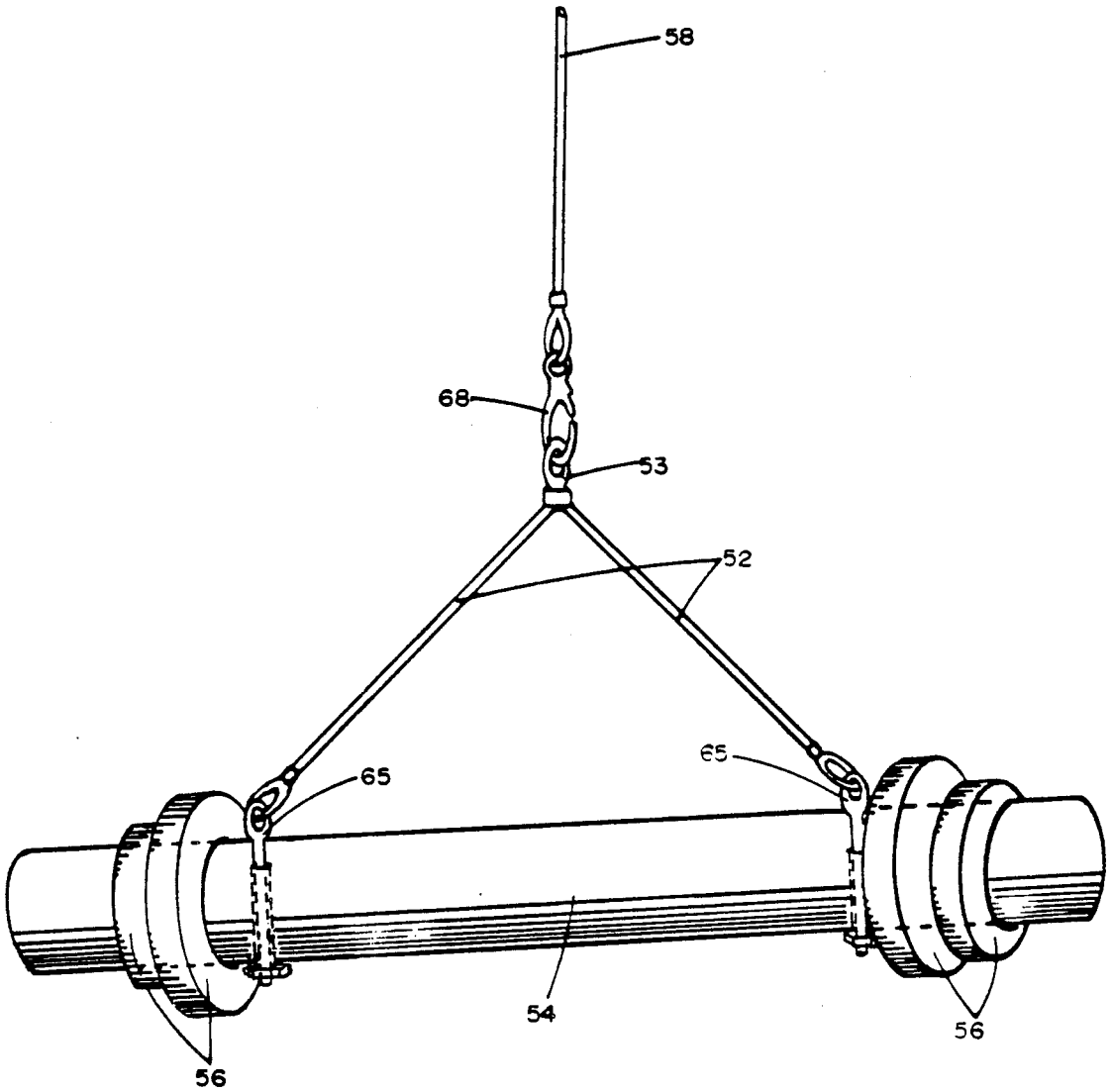
FIG. 4 is an enlarged perspective view of one of the dumbbells and the connecting cable harness associated therewith together with an eye hook, snap hook and cable support system.
Figure 8:
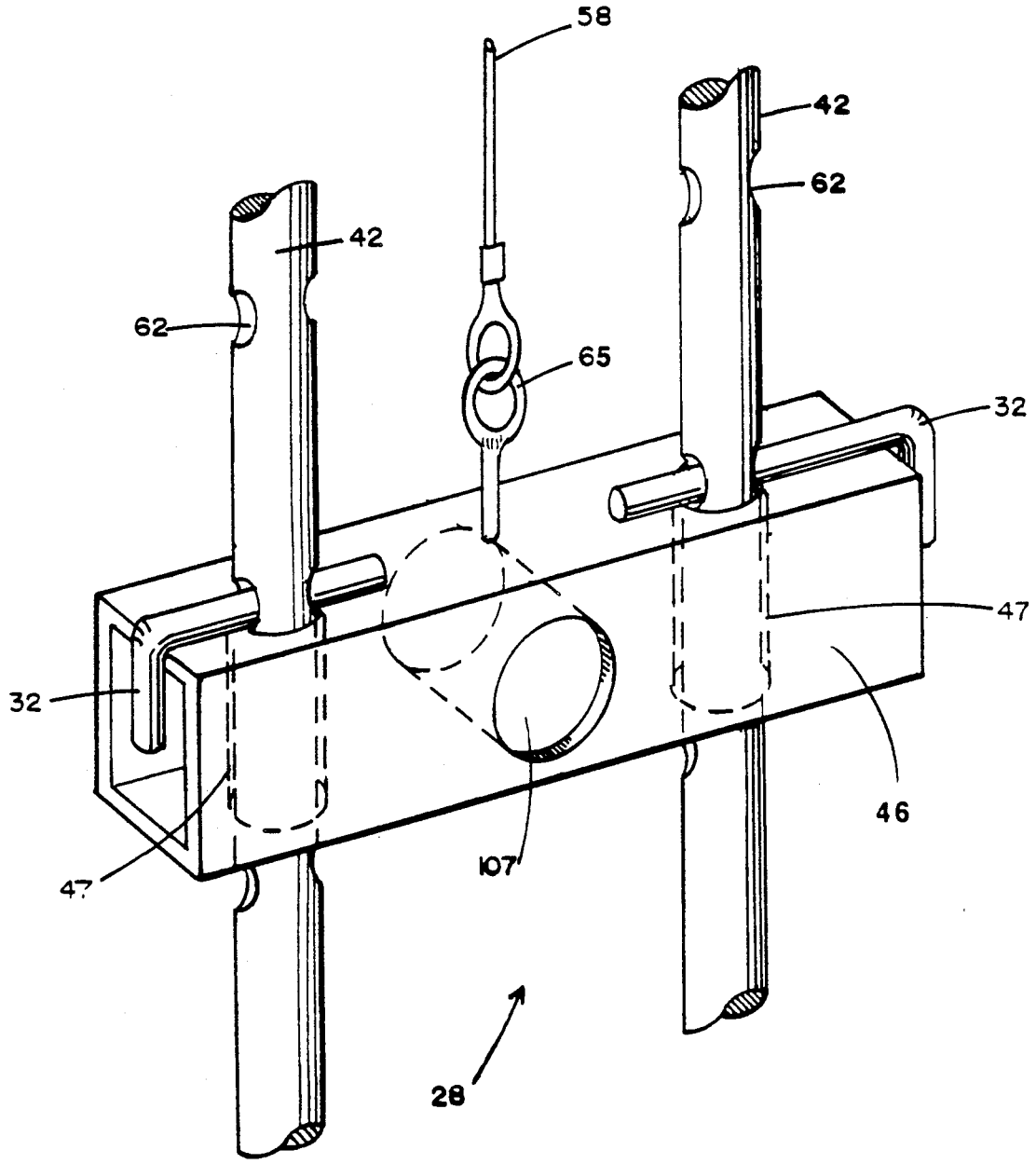
FIG. 8 is an enlarged perspective view of one of the slider systems for the double pair of vertical uprights.
Figure 9:
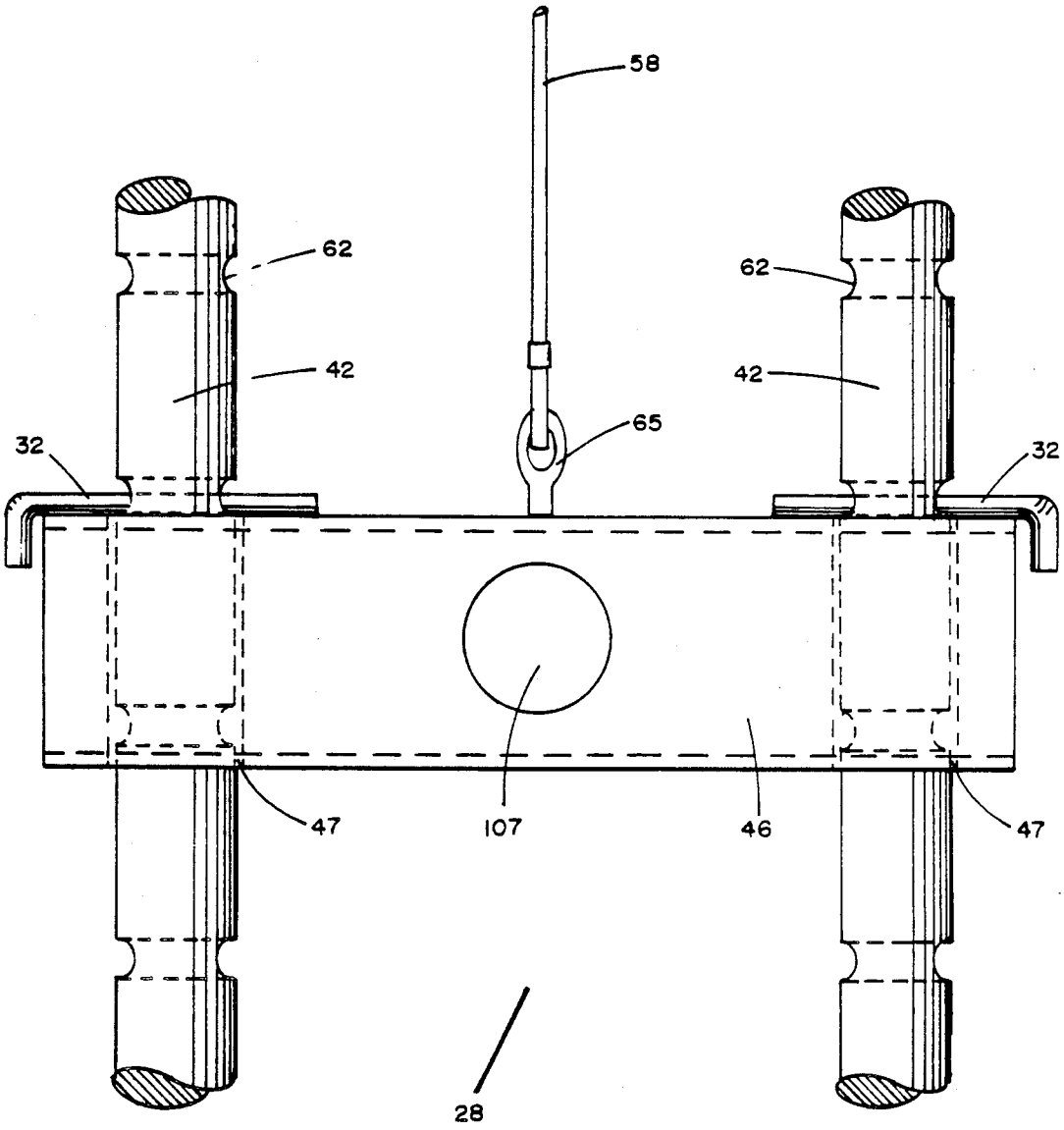
FIG. 9 is a sectional view of one of the slider systems for the double pair of vertical uprights generally upon a plane passing along the section line 2—2 of FIG. 5.
Figure 10:
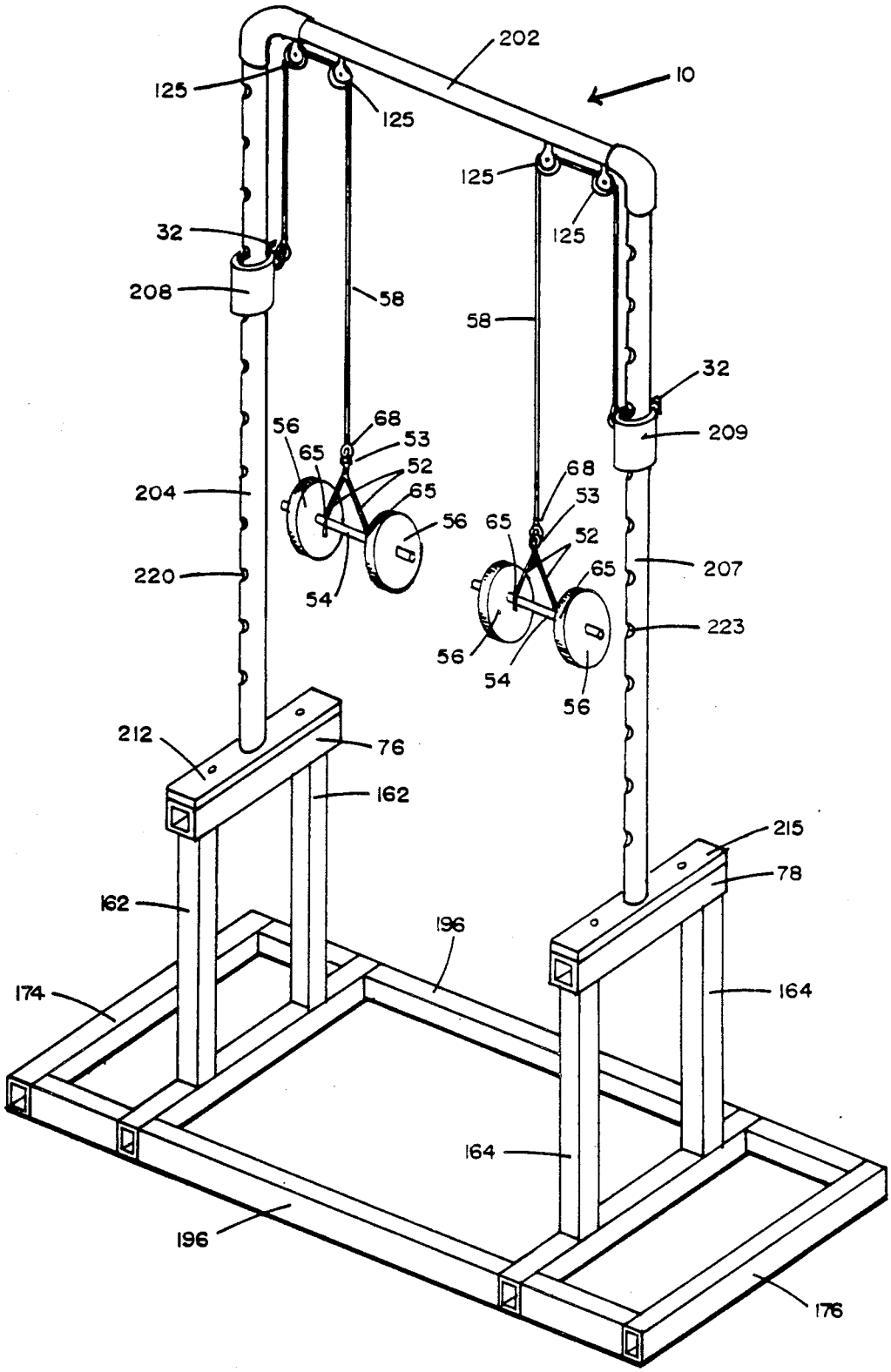
FIG. 10 is a perspective view of a second embodiment of the invention utilizing a single pair of vertical uprights.
Figure 11:
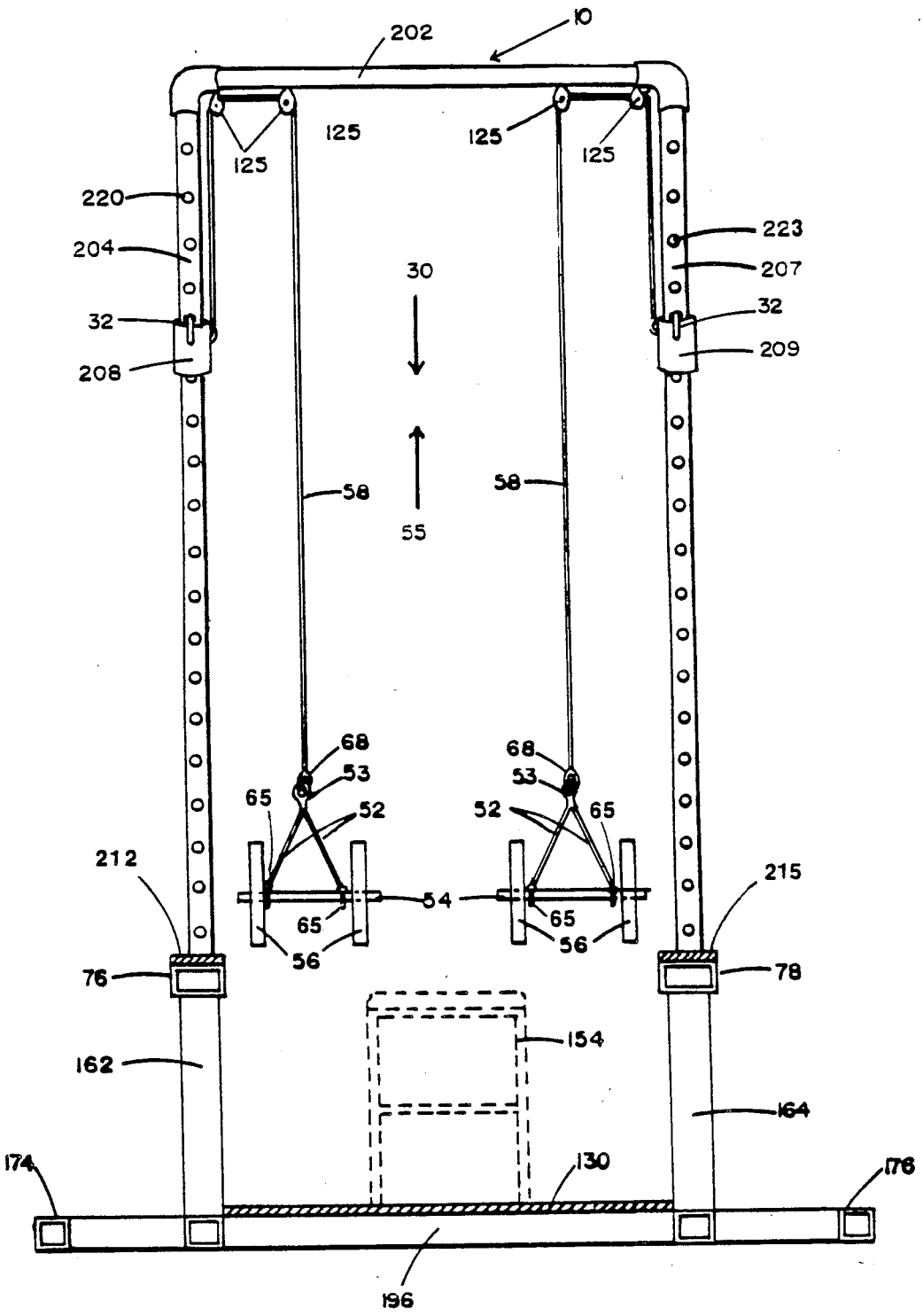
FIG. 11 is a front view of the second embodiment of the invention with dumbbells.
Figure 12:
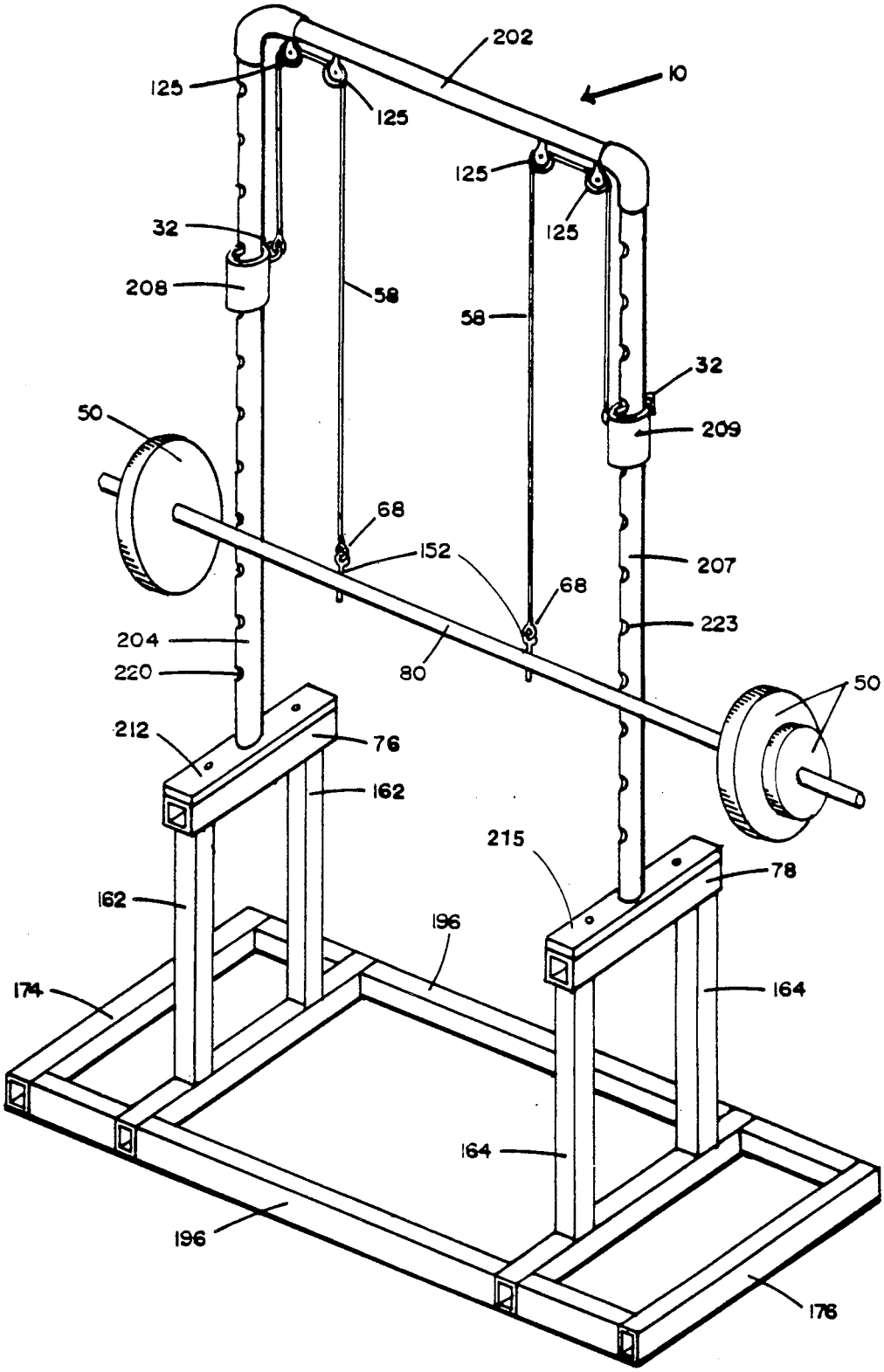
FIG. 12 is a perspective view of the second embodiment of the invention utilizing a barbell.
Figure 13:
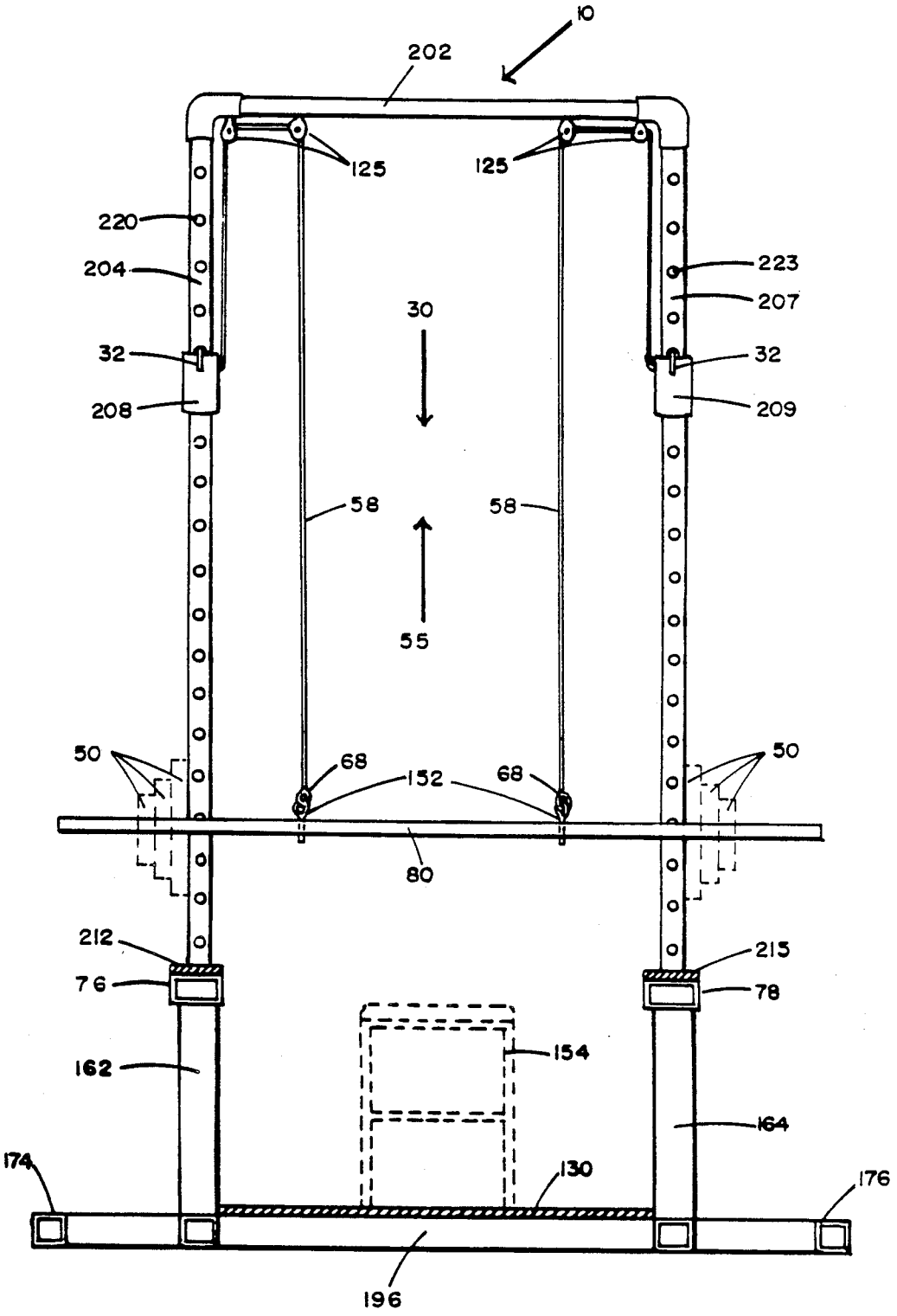
FIG. 13 is a front view of the second embodiment of the invention with a barbell.
Figure 14:
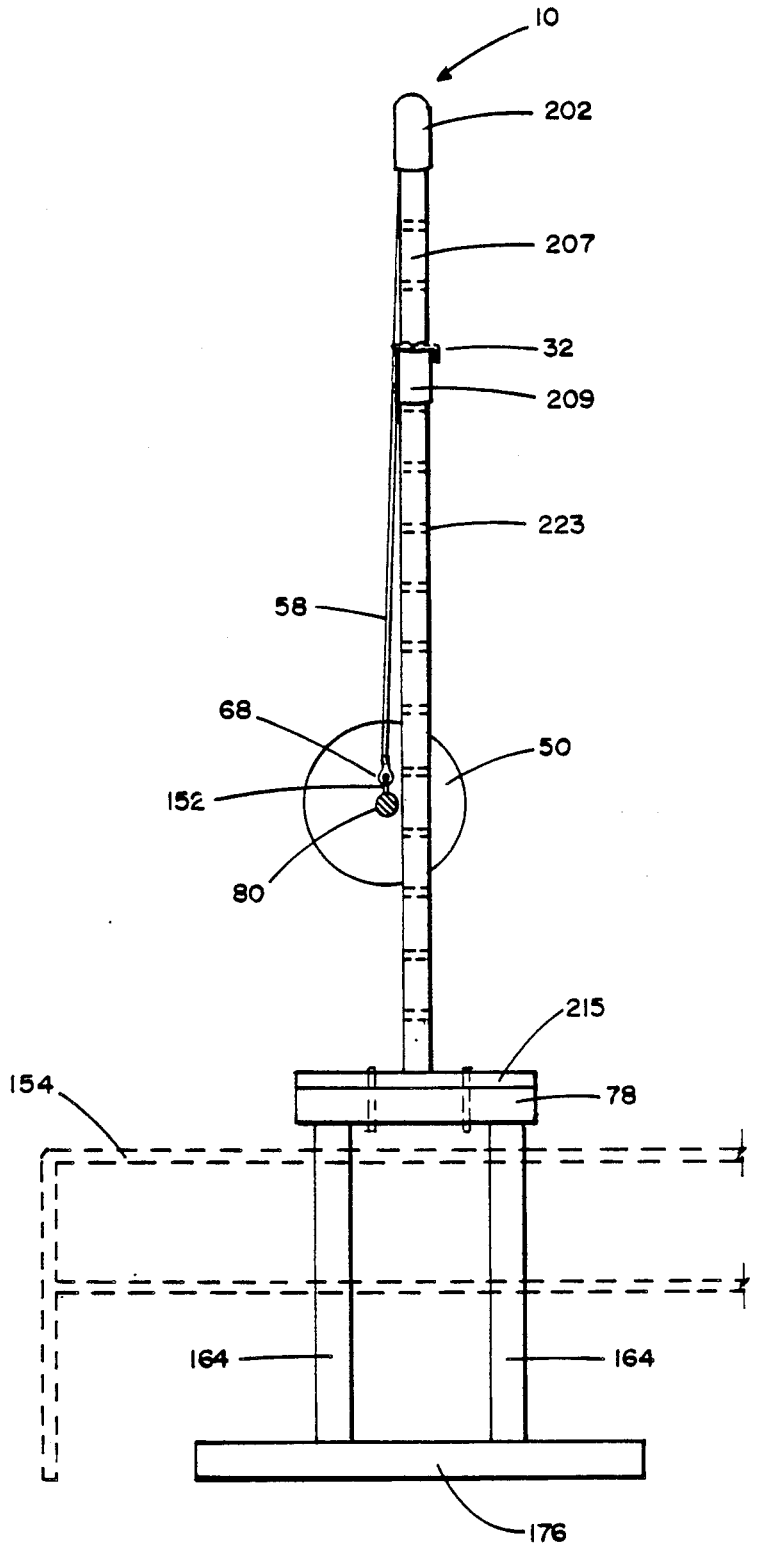
FIG. 14 is a side elevational view of the second embodiment of the invention with a barbell.
Figure 15:
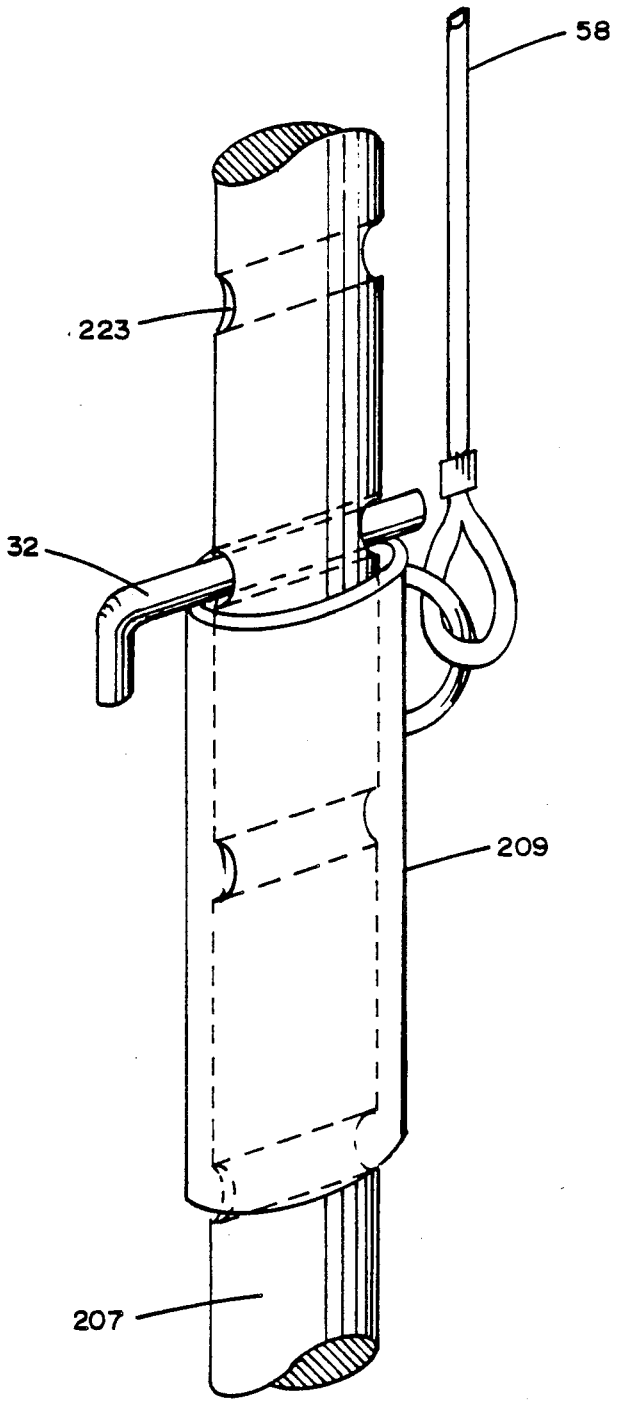
FIG. 15 is an enlarged perspective view of one of the slider systems used with the single pair of vertical uprights.

Referring in detail now to the drawings and particularly FIG. 1 wherein like reference numerals designate similar parts throughout the various views, the free weight exercising apparatus of the present invention is designated by reference numeral 10 for preventing injury to a weight lifter from dumbbell bars 54, having weights 56 on each end in the event of physical exhaustion of the weight lifter; and for closely adjusting the height of the dumbbell bars 54 relative to a weight lifter on a (dotted line) bench 154 as shown in FIG. 2 and FIG. 3. The weightlifting apparatus 10 as shown in FIG. 1 has a pair of bases 174 and 176, a pair of upright brace support members 162 and 164 a pair of lower transverse bars 196, a pair of longitudinally extending upper support members 20 and 22 with an upper transverse bar 18 connected to the center of the upper support members 20 and 22, a pair of longitudinally extending lower support members 76 and 78 which are welded to the upper ends of the pair of upright brace support members 162 and 164 whose lower ends are welded to the pair of bases 174 and 176 respectively and a pair of longitudinally extending movable slider assemblies 44 and 46. The top sides of the slider assemblies 44 and 46 contain eye hooks 65 for attaching one end of the cable supports 58 as shown in FIG. 8 and FIG. 9. A pair of pulleys 125 are attached to upper support members 20 and 22 respectively and a second pair of pulleys 125 are attached to upper transverse bar 18. The other ends of the cable supports 58 extend around the pair of pulleys 125 and have a snap hook 68 at one end thereof which may be releasably secured to the loop 53 of cable harness 52. (See FIG. 1, FIG. 2 and FIG. 4.) A first pair of vertical guide track support members 40—40 is inserted into the pair of holes 45 near the ends of the lower support member 76 and thereto through the channels in the pair of upright brace support members 162. A second pair of vertical guide track support members 42—42 is inserted into the pair of holes 45 near the ends of the lower support member 78 and thereto through the channels in the pair of upright base support members 164. As shown in FIG. 1, and FIG. 2 a first movable slider assembly 44 is inserted over the first pair of vertical guide track support members 40—40 through the pair of holes 47 near the ends of the slider assembly 44. FIG. 1, FIG. 2, FIG. 3, FIG. 8 and FIG. 9 show a second movable slider assembly 46 is inserted over the second pair of vertical guide track support members 42—42 through the pair of holes 47 near the ends of the slider assembly 46. As shown in FIG. 2 and FIG. 3 the first longitudinally extending upper support member 20 is inserted over the first pair of vertical guide track support members 40—40 into the pair of holes 49 near the ends of the upper support member 20. FIG. 2 and FIG. 3 show the second longitudinally extending upper support member 22 is inserted over the second pair of vertical guide track support members 42—42 into the pair of holes 49 near the ends of the upper support member 22. Referring now to FIG. 1, the first pair of vertical guide track support members 40—40 and the second pair of vertical guide track support members 42—42 are positioned in proximity to each other such as to create a first slot 26 and a second slot 28 respectively. As shown in FIG. 1 and FIG. 2 a first pair of vertical guide track support members 40—40 and the second pair of vertical guide track support members 42—42 respectively, have a uniform, coaxially aligned vertical series of holes 60 and 62 transversely through the vertical support members 40—40 and 42—42, the holes 60 in the first pair of vertical guide track support members 40—40 being in coaxial alignment and the holes 62 in the second pair of vertical guide track support members 42—42 correspondingly and similarly being in coaxial alignment. Illustrated in FIG. 1 the generally hollow rectangular slider assemblies 44 and 46 are slidably and adjustably mounted within the first slot 26 and within the second slot 28 respectively. One end of each of the cable supports 58 are connected to the eye hooks 65 which are attached to slider assemblies 44 and 46 respectively. The cables 58 support the weight bearing dumbbell bars 54 at a pre-determined height as shown in FIG. 2 and FIG. 3. The slider assemblies are capable of being adjusted to a predetermined height by the weight lifter by use of safety stop keys 32 slidably inserted through the holes 60—60 in the first pair of vertical guide track support members 40—40 and through the holes 62—62 in the second pair of vertical guide track support members 42—42 (see FIG. 1, FIG. 2, FIG. 3, FIG. 8 and FIG. 9.)

This structure represents the basic framework structure and these components are constructed of materials having the necessary size and strength capabilities for use as a free weight exercising apparatus. As shown in FIG. 2, if desired the pair of base members 174 and 176 may be anchored to the pair of lower transverse members 196 or a plywood or other material platform 130 as a supporting surface. The framework components may be rigidly fixed together as by welding, bolts, rivets and the like. Usually it is desirable for the pair of upright brace support members 162 and 164 to be welded to the pair of base members 174 and 176 and the pair of lower longitudinally extending support members 76 and 78 respectively. It is also usually desirable to have the pair of upper longitudinally support members 20 and 22 to be welded to the upper transverse bar 18. The dumbbell bars 54 usually have eye hooks 65 attached for connecting the cable harness 52. However, other means can be used to attach the cable harness 52 to the dumbbell bars 54.

Figure 5:
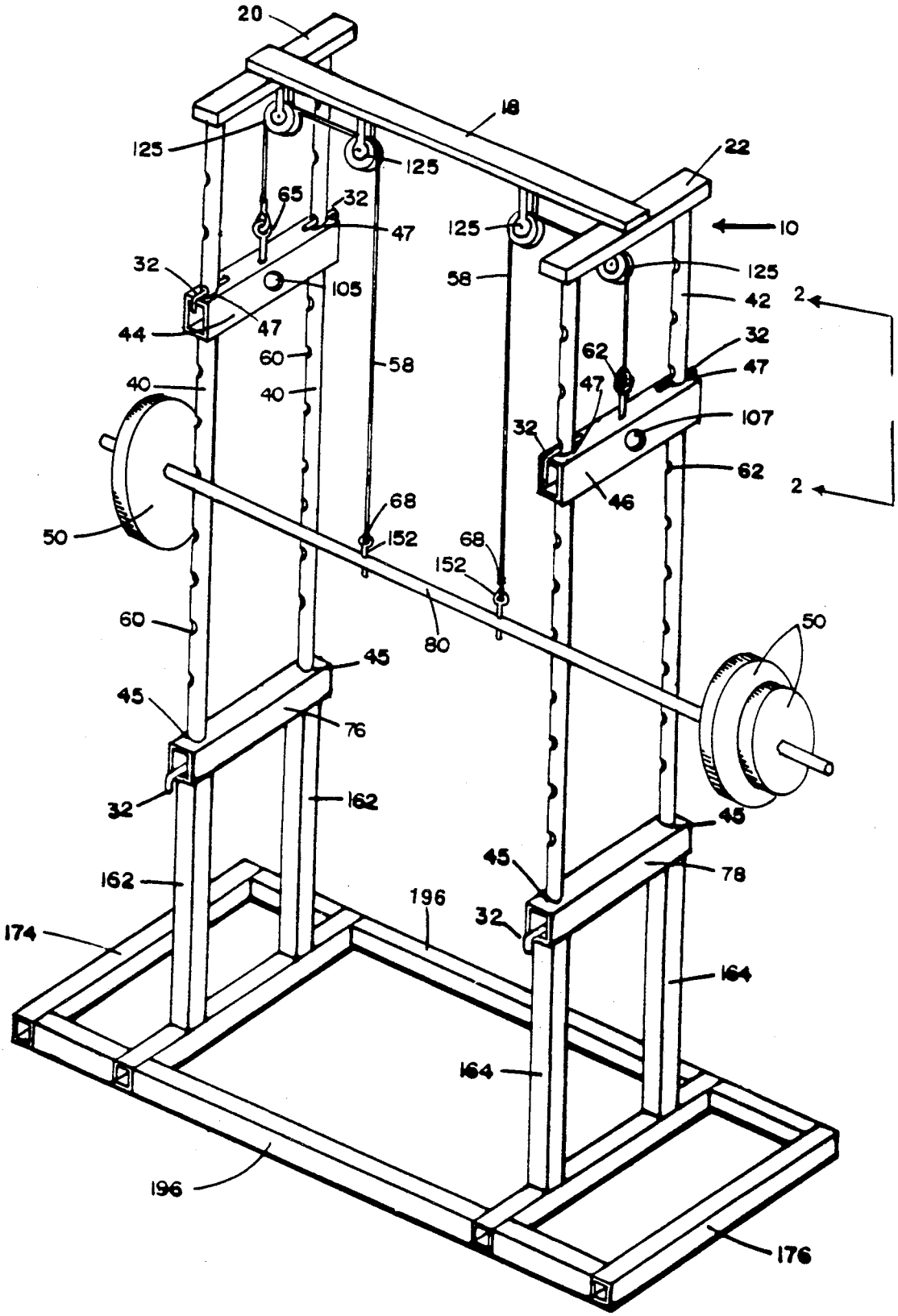
FIG. 5 is a perspective view of the preferred embodiment of the invention with a barbell.
Figure 6:
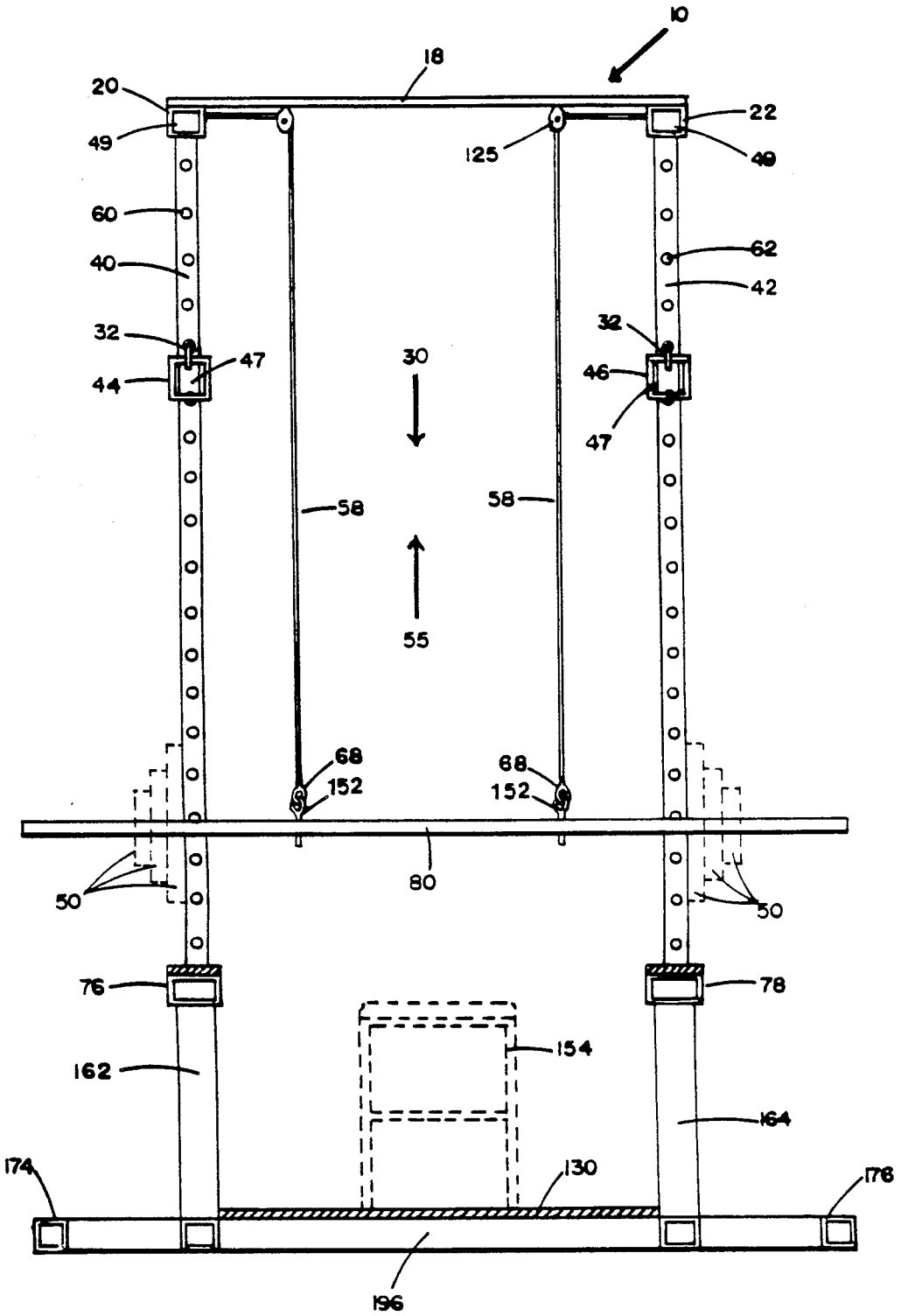
FIG. 6 is a front view of the preferred weightlifting apparatus with a barbell.

Another optional use of the apparatus is illustrated in FIG. 5 and FIG. 6 wherein it will be seen that when the dumbbell bars 54 with cable harnesses 52 are detached from the snap hooks 68 of the cable supports 58 a weighted barbell 80 with eye hooks 152 which are attached to the snap hooks 68 of the ends of the cable supports 58 can be used for performing exercises with a weighted barbell 80.

As understood, the weightlifting exercises such as bench presses, curls, flyes, military presses, squats, pulldowns and other exercises are performed by the weightlifter forcing the dumbbell bars 54 in an ascending movement using his arms or legs, said movement of the dumbbell bars 54 and weights 56 are along an unrestricted vertical or horizontal path. For completeness sake, it should be noted that the starting position for the dumbbell bars 54 with weights 56 and the slider assemblies 44 and 46 in relation to the vertical guide track support members 40—40 and 42—42 is determined by safety stop keys 32 of well known construction inserted into pre-determined coaxially aligned holes 60 and 62 of the vertical guide track support members 40—40 and 42—42 respectfully. That is, safety stop keys 32 limit the ascent of the slider assemblies 44 and 46 which in turn control the height of descent of the dumbbell bars 54 in any exercise.

FIG. 1, FIG. 2 and FIG. 3 show for example the embodiment of the invention 10 for performing exercises with dumbbell bars 54 and weight plates 56. The user can set up the apparatus by selecting a starting height at which they would feel most comfortable to begin an exercise. The user attaches the snap hooks 68 of the cable supports 58 to the eye loops 53 of the dumbbell cable harnesses 52 which are attached to eye hooks 65 of the dumbbell bars 54. The slider assemblies 44 and 46 on the vertical guide track support members 40—40 and 42—42 respectively, are raised to a height which will position the dumbbell bars 54 at the desired starting position for a specific exercise. Safety stop keys 32 are inserted into the coaxially aligned holes 60 and 62, of the pairs of the vertical guide track support members 40—40 and 42—42 at a point directly above the top side of the slider assemblies 44 and 46 respectively. (See FIG. 1, FIG. 2, FIG. 3 and FIG. 8.) In FIG. 1, FIG. 2 and FIG. 3 the slider assemblies 44 and 46 are shown in a raised position for performing the bench press. The weight lifter positions the bench (dotted lines) so that the head end of the bench 154 is properly located under the dumbbell bars 54 which are attached to the dumbbell cable harnesses 52 and the cable support systems 58. The other ends of the cable support systems 58 are attached to the slider assemblies 44 and 46 of the vertical guide track support members 40—40 and 42—42 respectively. As understood, the bench press is performed by the weight lifter lying on his back on the bench. He then is able, with outstretched arms, to raise the weight bearing dumbbell bars 54 in ascending movements 55 which in turn lower the slider assemblies 44 and 46 in descending movements 30 away from the safety stop keys 32. The weighted dumbbell bars 54 can be raised or lowered in any vertical or horizontal direction and the descent of the weightbearing dumbbell bars 54 are controlled by the cable support systems 58 that are attached to the eye hooks 65 of the slider assemblies 44 and 46 which are able to ascend only up to the safety stop keys 32. With the safety stop keys 32 in place the weighted dumbbells 54 will remain suspended at the selected starting position at the completion of an exercise therefore allowing the user the freedom of resting between sets of an exercise and again repeating the exercise with the suspended weighted dumbbell bars 54. This eliminates the need at the completion of an exercise to place the weighted dumbbells 54 on the floor and upon resuming the exercise to have to once again pick up the weighted dumbbells 54 from the floor and raise them to the desired starting position to perform the selected exercise. The weight lifter makes a number of these ascending movements 55 and descending movements 30 in accordance with his weightlifting exercise routine. During the ascending movements 55 and descending movements 30 the weight lifter has the ability to safely and easily rotate the weight bearing dumbbell bars 54 since they have unrestricted horizontal and vertical movement. This freedom of movement does not limit the angle of movement on the wrist, elbow and shoulder joints during the ascending movements 55 or descending movements 30 therefore reducing stress on these joints. In other known weightlifting apparatus a weight bearing bar is appropriately affixed, as by welding or the like to a cylindrical or other shaped members inserted over upright guide tracks to provide a sliding movement of the weight bearing bar in a fixed vertical path. The weight bearing bar is pressed upward or lowered in a straight, fixed upward and downward path which locks the wrist, elbow and shoulder joints into an unnatural position and which places great stress on these joints and can cause injuries to the joints.

Figure 7:
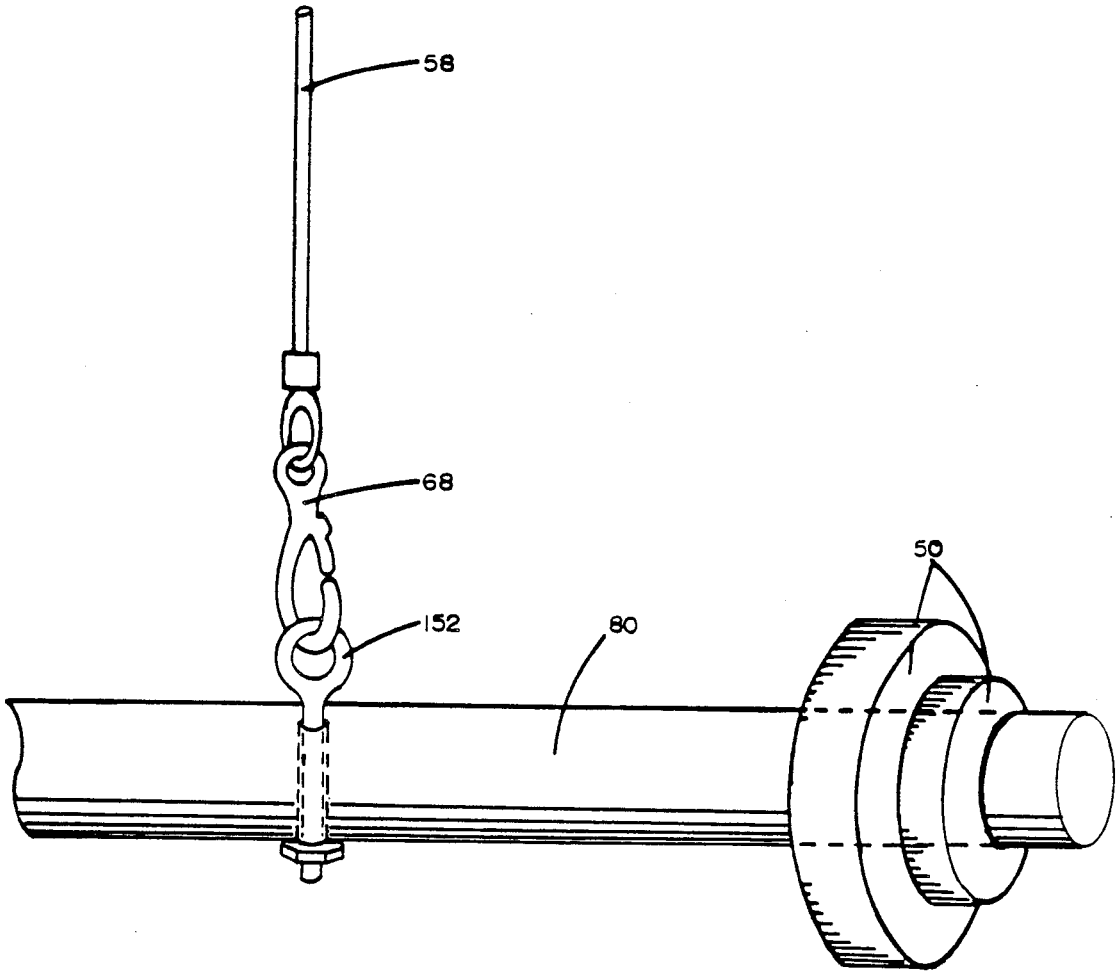
FIG. 7 is an enlarged fragmental perspective view of the weight bar with weight plates, eye hook, snap hook and the cable support system.

Another optional use of the apparatus as shown in FIG. 5, FIG. 6 and FIG. 7 is that a weighted barbell 80 can be used in place of the weighted dumbbell bars 54 to perform all of the weightlifting exercises with the same safety and versatility as using the weighted dumbbell bars 54. To perform barbell 80 exercises the same procedure used for selecting the desired exercise height using dumbbell bars 54 would be repeated using the slider assemblies 44 and 46 and safety stop keys 32. The eye loop 53 of the dumbbell cable harness 52 would be unhooked from the snap hook 68 of cable support systems 58 and the eye hooks 152 attached to barbell 80 would be connected to the snap hooks 68 of the cable support systems 58. The desired number of weighted plates 50 would then be placed on the ends of the barbell 80 in order to perform the selected exercises.

Alternative Guide Track Construction

FIG. 10, FIG. 11, FIG. 12, FIG. 13, FIG. 14 and FIG. 15 show the invention using a single pair of vertical guide track support members 204 and 207 which represent a modification of the basic double pair of vertical guide track support members 40—40 and 42—42 used in FIG. 1. Single vertical guide track support members 204 and 207 are designed to be used with lower support members 212 and 215 and slider assemblies 208 and 209 respectively and upper support member 202. In order to convert from a double pair of vertical guide track support members 40—40 and 42—42 to a single pair of vertical guide track support members 204 and 207 the double pair of vertical upright support members 40—40 and 42—42 are removed from the lower support members 76 and 78 respectively. The single pair of vertical upright support members 204 and 207 are attached by lower support members 212 and 215 to lower support members 76 and 78 respectively. This system allows all of the same basic exercises to be performed as were performed with the double pair of vertical guide track support members 40—40 and 42—42. The procedures for using the single pair of vertical guide track support members 204 and 207, the slider assemblies 208 and 209, holes 220 and 223 and safety stop keys 32, are the same as the procedures used for the double pair of vertical guide track support members 40—40 and 42—42, slider assemblies 44 and 46, holes 60 and 62 and safety stop keys 32.

Figure 16:
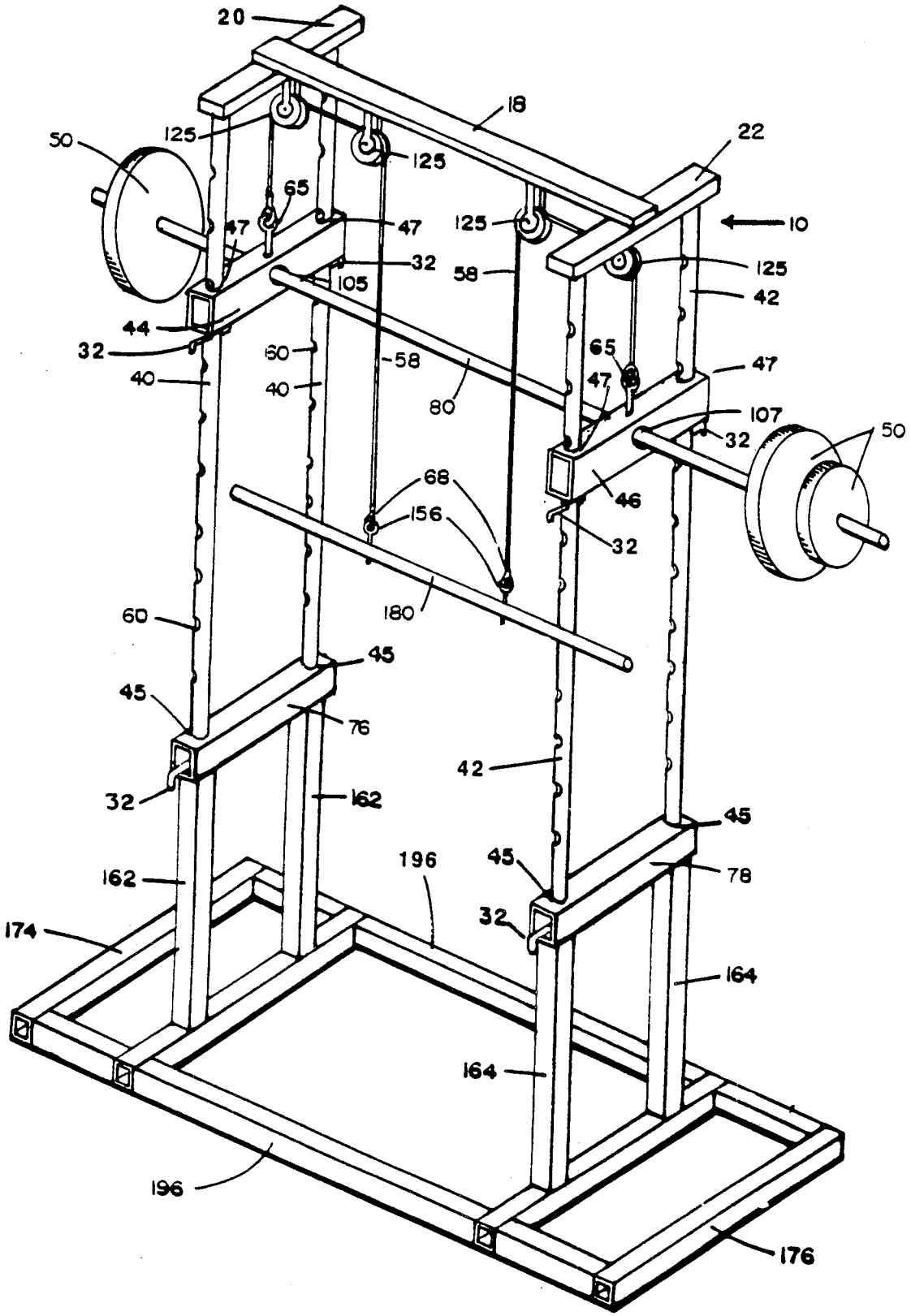
FIG. 16 is a perspective view of the preferred embodiment of the invention for performing pulldown and pushdown exercises.

Another feature of the invention is shown in FIG. 16. The barbell 80 is inserted through holes 105 and 107 of slider assemblies 44 and 46 respectively. Weight plates 50 are placed on each end of the barbell 80. Snap hooks 68 of cable support system 58 are attached to the eye hooks 156 of the handle bar 180. Safety stop keys 32 are placed into holes 60 and 62 of vertical guide track support members 40—40 and 42—42 respectively. The holes 60 and 62 are selected at a desired height below the underside of slider assemblies 44 and 46 in order to prevent the crashing down of the weight on an exerciser during any pushdown or pulldown exercise.

From the foregoing description it should be readily appreciated as shown in FIG. 1, FIG. 5, FIG. 10, FIG. 12 and FIG. 16 the inventive device 10 is adapted, both by its construction and operational mode, to permit a wide range of weightlifting exercises.

While this invention has been described in terms of preferred embodiment it will be clear to those skilled in the art that various alterations, modifications, permutations and rearrangements of the parts may be made without departing from the spirit and scope of the underlying inventive concept. A latitude of modifications, change and substitution is intended in the foregoing disclosure and in some instances some features of the invention will be employed without a corresponding use of other features, accordingly it is appropriate that the appended claims be interpreted as including such alterations, modifications, permutations and rearrangements as fall within the true spirit and scope of the invention herein.

What is claimed and desired to be protected by United States Patent is:

1. A weightlifting apparatus for preventing injury to a weight lifter comprising:

a framework including a pair of laterally spaced base sections, an upright support brace mounted on each base section, a lower support member mounted on the top of each support brace, a pair of spaced vertical uprights comprising vertical track support guide members extending vertically upwardly from each lower support member, said vertical uprights being positioned in proximity to each other creating a slot and having a plurality of aligned apertures extending therethrough at regular intervals, an upper support member mounted to and extending between the upper end of each pair of vertical uprights, an upper transverse bar mounted to and extending between said upper support members, and a pair of lower transverse bars mounted to and extending between said base sections;

a weight bearing bar;

a first and second slider, one slider being slidably mounted on each pair of vertical uprights;

two pairs of safety stop keys, one safety stop key being removably insertable in said aligned apertures of each said vertical upright, said safety stop keys extending through said vertical uprights and defining the upper limit of travel of said slider on said vertical uprights;

a first and second pulley system mounted on said upper support;

a first and second cable, said first cable having a first end connected to said first slider, being trained through said first pulley system and having a second end connected to said weight bearing bar, said second cable having a first end connected to said second slider, being trained through said second pulley system and having a second end connected to said weight bearing bar;

whereby said safety stop keys may be inserted into said vertical uprights at a predetermined location such that said safety stop keys will prevent upward travel of said slider and thus prevent downward travel of said weight bearing bar below a second predetermined location.

2. The weightlifting apparatus as recited in claim 1 wherein the second end of each said cable is connected to points along said weight bearing bar such that said weight bearing bar is suspended in a balanced horizontal position.

3. The weightlifting apparatus as recited in claim 1 wherein the second end of each said cable is removably connected to said weight bearing bar.

4. The weightlifting apparatus as recited in claim 1 wherein said weight bearing bar includes ends adapted to receive replaceable weights thereon.

5. A weightlifting apparatus for preventing injury to a weight lifter comprising:

a framework including a pair of laterally spaced base sections, an upright support brace mounted on each base section, a lower support member mounted on the top of each support brace, a pair of spaced vertical uprights comprising vertical track support guide members extending vertically upwardly from each lower support member, said vertical uprights being positioned in proximity to each other creating a slot and having a plurality of aligned apertures extending therethrough at regular intervals, an upper support member mounted to and extending between the upper end of each pair of vertical uprights, an upper transverse bar mounted to and extending between said upper support members, and a pair of lower transverse bars mounted to and extending between said base sections;

a first and second dumbbell bar;

a first and second slider, one slider being slidably mounted on each pair of vertical uprights;

two pairs of safety stop keys, one safety stop key being removably insertable in said aligned apertures of each said vertical upright, said safety stop keys extending through said vertical uprights and defining the upper limit of travel of said slider on said vertical uprights;

a first and second pulley system mounted on said upper support;

a first and second cable, said first cable haivng a first end connected to said first slider, being trained through said first pulley system and having a second end connected to said first dumbbell bar, said second cable having a first end connected to said second slider, being trained through said second pulley system and having a second end connected to said second dumbbell bar;

whereby said safety stop keys may be inserted into said vertical uprights at a predetermined location such that said safety stop keys will prevent upward travel of said slider and thus prevent downward travel of said first and second dumbbell bars below a second predetermined location.

6. The weightlifting apparatus as recited in claim 5 wherein the second end of each said cable is connected to each dumbbell bar such that said dumbbell bars are suspended in a balanced horizontal position.

7. The weightlifting apparatus as recited in claim 5 wherein the second end of each said cable is removably connected to each of said dumbbell bars.

8. The weightlifting apparatus as recited in claim 5 wherein each said dumbbell bar includes ends adapted to receive replaceable weights thereon.

9. A weightlifting apparatus for preventing injury to a weight lifter comprising:

a framework including a pair of laterally spaced base sections, an upright support brace mounted on each base section, a lower support member mounted on the top of each support brace, a spaced vertical upright comprising a vertical track support guide member extending vertically upwardly from each lower support member, said vertical upright having a plurality of aligned apertures extending therethrough at regular intervals, an upper transverse bar mounted to and extending between said vertical uprights, and a pair of lower transverse bars mounted to and extending between said base sections;

a first and second dumbbell bar;

a first and second slider, one slider being slidably mounted on each vertical upright;

two pairs of safety stop keys, one safety stop key being removably insertable in said apertures of each said vertical upright, said safety stop keys extending through said vertical uprights and defining the upper limit of travel of said slider on said vertical uprights;

a first and second pulley system mounted on said upper support;

a first and second cable, said first cable having a first end connected to said first slider, being trained through said first pulley system and having a second end connected to said first dumbbell bar, said second cable having a first end connected to said second slider, being trained through said second pulley system and having a second end connected to said second dumbbell bar;

whereby said safety stop keys may be inserted into said vertical uprights at a predetermined location such that said safety stop keys will prevent upward travel of said slider and thus prevent downward travel of said first and second dumbbell bars below a second predetermined location.

10. The weightlifting apparatus as recited in claim 9 wherein the second end of each said cable is connected to each dumbbell bar such that said dumbbell bars are suspended in a balanced horizontal position.

11. The weightlifting apparatus as recited in claim 9 wherein the second end of each said cable is removably connected to each of said dumbbell bars.

12. The weightlifting apparatus as recited in claim 9 wherein each said dumbbell bar includes ends adapted to receive replaceable weights thereon.

13. A weightlifting apparatus for preventing injury to a weight lifter comprising:

a framework including a pair of laterally spaced base sections, an upright support brace mounted on each base section, a lower support member mounted on the top of each support brace, a spaced vertical upright comprising a vertical track support guide member extending vertically upwardly from each lower support member, said vertical upright having a plurality of aligned apertures extending therethrough at regular intervals, an upper transverse bar mounted to and extending between said vertical uprights, and a pair of lower transverse bars mounted to and extending between said base sections;

a weight bearing bar;

a first and second slider, one slider being slidably mounted on each vertical upright;

two pairs of safety stop keys, one safety stop key being removably insertable in said apertures of each said vertical upright, said safety stop keys extending through said vertical uprights and defining the upper limit of travel of said slider on said vertical uprights;

a first and second pulley system mounted on said upper support;

a first and second cable, said first cable having a first end connected to said first slider, being trained through said first pulley system and having a second end connected to said weight bearing bar, said second cable having a first end connected to said second slider, being trained through said second pulley system and having a second end connected to said weight bearing bar;

whereby said safety stop keys may be inserted into said vertical uprights at a predetermined location such that said safety stop keys will prevent upward travel of said slider and thus prevent downward travel of said weight bearing bar below a second predetermined location.

14. The weightlifting apparatus as recited in claim 13 wherein the second end of each said cable is connected to points along said weight bearing bar such that said weight bearing bar is suspended in a balanced horizontal position.

15. The weightlifting apparatus as recited in claim 13 wherein the second end of each said cable is removably connected to said weight bearing bar.

16. The weightlifting apparatus as recited in claim 13 wherein said weight bearing bar includes ends adapted to receive replaceable weights thereon.

17. A weightlifting apparatus for preventing injury to a weight lifter comprising:

a framework including a pair of laterally spaced base sections, an upright support brace mounted on each base section, a lower support member mounted on the top of each support brace, a pair of spaced vertical uprights comprising vertical track support guide members extending vertically upwardly from each lower support member, said vertical uprights being positioned in proximity to each other creating a slot and having a plurality of aligned apertures extending therethrough at regular intervals, an upper support member mounted to and extending between the upper end of each pair of vertical uprights, an upper transverse bar mounted to and extending between said upper support members, and a pair of lower transverse bars mounted to and extending between said base sections;

a handle bar;

a first and second slider, one slider being slidably mounted on each pair of vertical uprights, each said slider having an aperture extending through the central portion thereof;

two pairs of safety stop keys, one safety stop key being removably insertable in said aligned apertures of each said vertical upright, said safety stop keys extending through said vertical uprights and defining the upper limit of travel of said slider on said vertical uprights;

a weight bearing bar, said weight bearing bar being received in said horizontally extending aperture in each said slider;

a first and second pulley system mounted on said upper support;

a first and second cable, said first cable having a first end connected to said weight bearing bar, being trained through said first pulley system and having a second end connected to said handle bar, said second cable having a frist end connected to said weight bearing bar, being trained through said second pulley system and having a second end connected to said handle bar;

whereby said safety stop keys may be inserted into said vertical uprights at a predetermined location such that said safety stop keys will prevent upward travel of said slider and said weight bearing bar, thus preventing downward travel of said handle bar below a second predetermined location.

18. The weightlifting apparatus as recited in claim 17 wherein the second end of each said cable is connected to points along said handle bar such that said handle bar is suspended in a balanced horizontal position.

19. The weightlifting apparatus as recited in claim 17 wherein the second end of each said cable is removably connected to said handle bar.

20. The weightlifting apparatus as recited in claim 17 wherein said weight bearing bar includes ends adapted to receive replaceable weights thereon.

* * * * *